US006523006B1

(12) United States Patent
Ellis et al.

(10) Patent No.: US 6,523,006 B1
(45) Date of Patent: Feb. 18, 2003

(54) THREE DIMENSIONAL AUDIO VISION

(75) Inventors: David G. Ellis, Hillsboro, OR (US); Louis J. Johnson, Aloha, OR (US); Balaji Parthasarathy, Hillsboro, OR (US); Peter B. Bloch, Portland, OR (US); Steven R. Fordyce, Salem, OR (US); Bill Munson, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/013,848

(22) Filed: Jan. 27, 1998

(51) Int. Cl.[7] ..... G10K 13/08
(52) U.S. Cl. ..... 704/270; 382/110; 340/435
(58) Field of Search ..... 704/260, 270, 704/273, 276; 382/135, 110, 114, 54; 340/435

(56) References Cited

U.S. PATENT DOCUMENTS 3,704,345 A * 11/1972 Coker et al. ..... 704/260
5,020,108 A * 5/1991 Wason ..... 342/28
5,412,738 A * 5/1995 Brunelli et al. ..... 382/115
5,699,057 A * 12/1997 Ikeda et al. ..... 340/435
5,732,227 A * 3/1998 Kuzunuki et al. ..... 345/775
6,091,546 A * 7/2000 Spitzer ..... 345/8
6,115,482 A * 9/2000 Sears et al. ..... 348/62
6,256,401 B1 * 7/2001 Whited ..... 382/110
6,349,001 B1 * 2/2002 Spitzer ..... 345/8

* cited by examiner

*Primary Examiner*—David D. Knepper
(74) *Attorney, Agent, or Firm*—Blakely, Sokoloff, Taylor & Zafman LLP

(57) ABSTRACT

Video data is received from multiple video receptors. This multidimensional video data is converted from the video receptors into a multidimensional audio representation of the multidimensional video data and are the multidimensional audio representation is output using multiple audio output devices. The conversion of the multidimensional video data includes generating a three-dimensional representation of the multidimensional video data, and generating an audio landscape representation with three-dimensional features based on the three-dimensional representation.

22 Claims, 4 Drawing Sheets

THREE DIMENSIONAL AUDIO VISION

BACKGROUND OF THE INVENTION

1. Field of the Invention

The present invention pertains to the field of vision enhancement. More particularly, this invention relates to the art of providing an optical vision substitute.

2. Background

Eyesight is, for many people, the most important of all the senses. Unfortunately, not everyone enjoys perfect vision. Many visually impaired people have developed their other senses to reduce their reliance on optical vision. For instance, the visually impaired can learn to use a cane to detect objects in one's immediate vicinity. Braille provides a means by which visually impaired people can read text. Hearing can be developed to recognize the flow and direction of traffic at an intersection. Seeing eye dogs can be trained to provide excellent assistance.

Technology has sought to provide additional alternatives for the visually impaired. Corrective lenses can improve visual acuity for those with at least some degree of optical sensory perception. Surgery can often correct retinal or nerve damage, and remove cataracts. Sonar devices have also been used to provide the visually impaired with an audio warning signal when an object over a specified size is encountered within a specified distance.

A need remains, however, for an apparatus to provide an audio representation of one's surroundings.

SUMMARY OF THE INVENTION

In accordance with the teachings of the present invention, a method and apparatus to create an audio representation of a three dimensional environment is provided. One embodiment includes a plurality of video receptors, a plurality of audio output devices, and a converter. The converter receives multidimensional video data from the plurality of video receptors, converts the multidimensional video data into a multidimensional audio representation of the multidimensional video data, and outputs the multidimensional audio representation to the plurality of audio output devices.

BRIEF DESCRIPTION OF THE DRAWINGS

Examples of the present invention are illustrated in the accompanying drawings. The accompanying drawings, however, do not limit the scope of the present invention in any way. Like references in the drawings indicate similar elements.

DETAILED DESCRIPTION

In the following detailed description, exemplary embodiments are presented in connection with the figures and numerous specific details are set forth in order to provide a thorough understanding of the present invention. However, it will be understood by those skilled in the art that the present invention may be practiced without these specific details, that the present invention is not limited to the depicted embodiments, and that the present invention may be practiced in a variety of alternate embodiments. Accordingly, the innovative features of the present invention may be practiced in a system of greater or lesser complexity than that of the system depicted in the figures. In other instances well known methods, procedures, components, and circuits have not been described in detail.

Figure 1A:
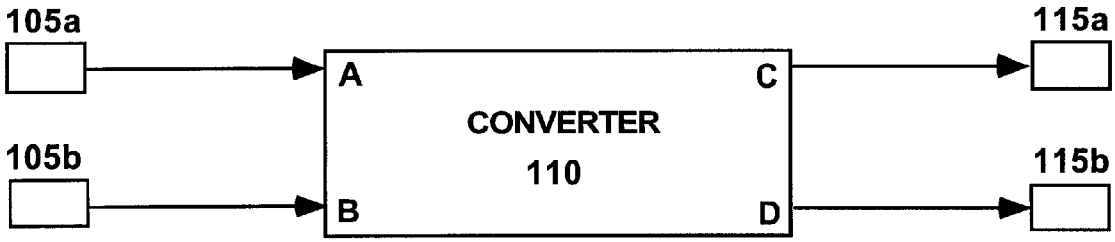
FIG. 1A is a block diagram illustrating one embodiment of the present invention.

FIG. 1A is a block diagram of one embodiment of the present invention. Video receptors 105*a* and 105*b* receive light input and provide multidimensional video data to input ports A and B of converter 110. Converter 110 receives the multidimensional video data, converts it to a multidimensional audio representation, and provides the multidimensional audio representation to audio output devices 115*a* and 115*b* from output ports C and D. Audio output devices 115*a* and 115*b* output the multidimensional audio representation.

Figure 1B:
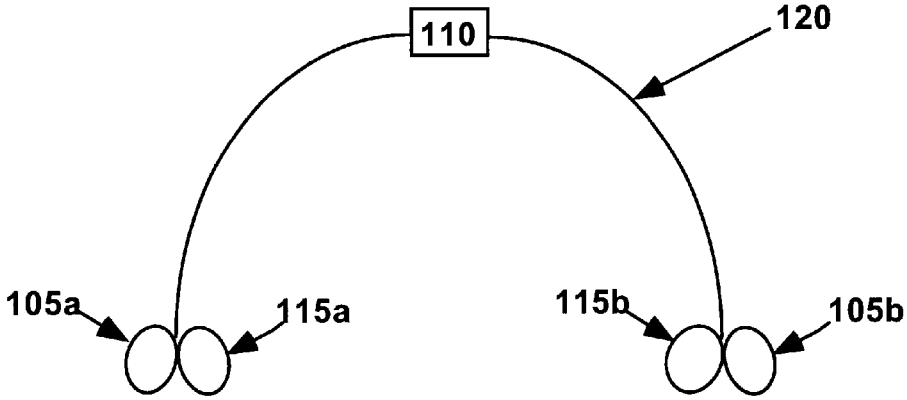
FIG. 1B illustrates one embodiment of the present invention employed with a headset.

FIG. 1B is an illustration of one embodiment of the present invention employed using a headset 120. Headset 120 is not a necessary element, and any number of other configures could be used to practice the present invention. In FIG. 1B, headset 120 is operative to fit over the head of a user so that audio output devices 115*a* and 115*b* are close enough to the user's ears so that the user can hear audio signals produced by audio output devices 115*a* and 115*b*. Audio output devices 115*a* and 115*b* can be ear inserts that fit into the ear canal, or earphones that rest on the outside of the ear. Video receptors 105*a* and 105*b* can be small video cameras affixed to headset 120 so that, when the headset is worn, video receptors 105*a* and 105*b* are on either side of the user's head, and receive light from the general direction in which the head is pointed. In alternate embodiments, three or more video receptors could be employed. With additional video receptors, the composite field of view for all of the video receptors together could provide a 360 degree perspective.

Converter 110 can be affixed to headset 120 as shown, or converter 110 can be located elsewhere, such as in a pocket, clipped to a belt, or located remotely. Wires can be used to couple converter 110 to the video receptors and audio output devices, or wireless communications can be used such as infra-red and radio frequency communications.

Figure 2:
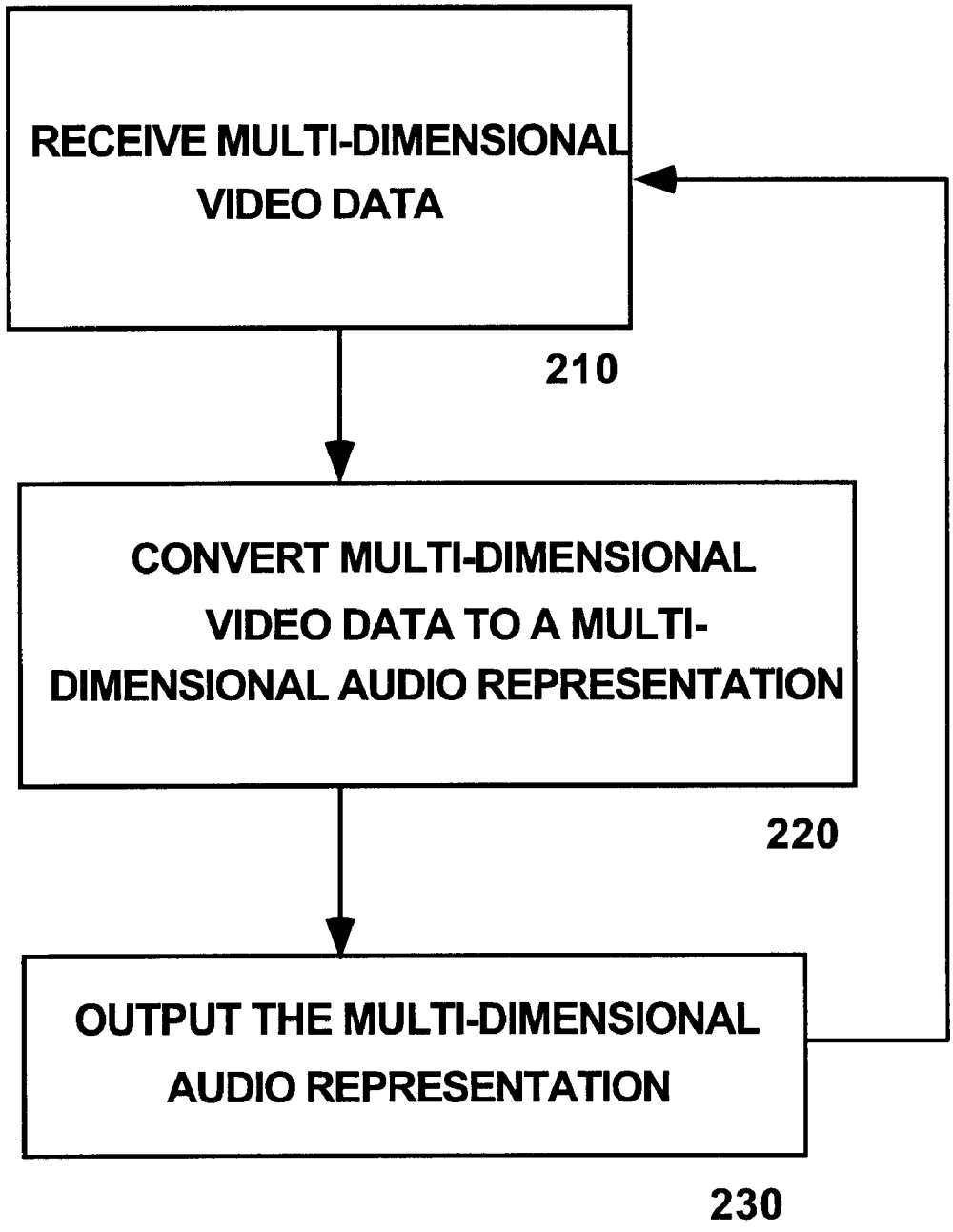
FIG. 2 is a flow chart illustrating the method of one embodiment of the present invention.

FIG. 2 is a flow chart illustrating the process of the present invention. Sensors 105*a* and 105*b* continually provide multidimensional video data in block 210. Converter 110 converts the multidimensional video data into multidimensional audio representations in block 220. The audio representations are provided by audio output devices 115*a* and 115*b* in block 230. The process is continually repeated, providing a real time audio representation of the surroundings.

Figure 3A:
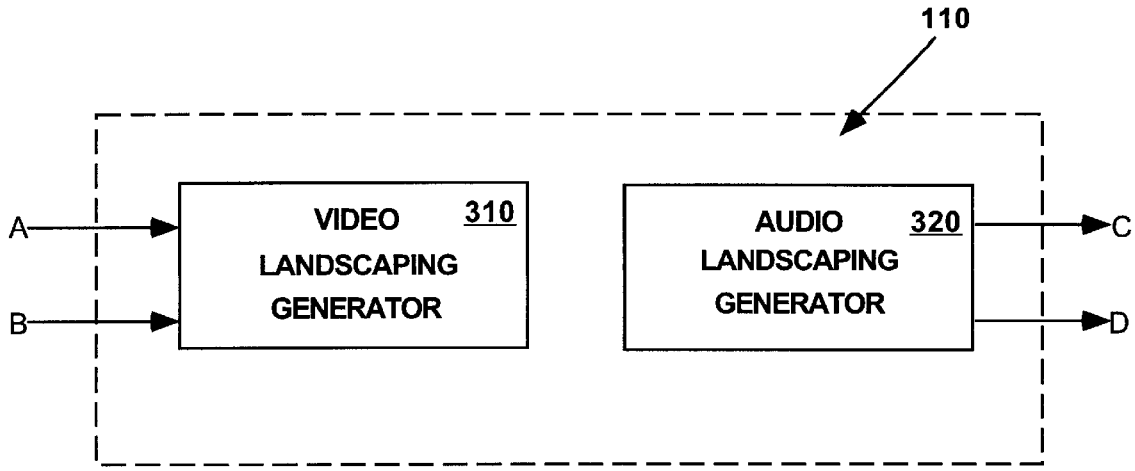
FIG. 3A is a block diagram illustrating one embodiment of video to audio landscaping.

When in use, video receptors 105*a* and 105*b* each provide a video image of the area in the direction the head is pointed. Converter 110 compiles and analyzes the two video images. As shown in FIG. 3A, video landscaping generator 310 generates a video landscape. The video landscape is provided to audio landscape generator 320 to generate an audio landscape based on the video landscape.

The video landscape comprises a body of data representing objects and distances to the objects with relation to video receptors 105*a* and 105*b* in three dimensional space. The invention can be calibrated initially, or on a continuing basis, to determine the distance between the cameras, and the relation of the cameras to the ground. For instance, video receptors 105*a* and 105*b* could be equipped with inclination sensors (not shown). Converter 110 could calculate the angle of the video receptors with relation to an identified point on the ground using the angle of inclination from the inclination sensors and the angle of the identified point off the center of the field of view. Then converter 110 could calculate how high the video receptors are off the ground based on that angle and the distance to the identified point on the ground. The distance to the identified point, as with any object in the field of view, can be measured based on the two perspectives of the video receptors. Then, distances to objects and the relation of the objects to the video receptors can be calculated based on the distance between the two perspectives of the video receptors, the inclination of the video receptors, the position of the object in the field of view, and the height of the video receptors off the ground.

The distances and positions are converted into audio representations with differentiating frequencies and volumes for different objects at different distances. As the user turns his or her head from side to side, tilts his or her head up and down, and moves about a landscape, the audio representations change according to the video landscape.

Figure 3B:
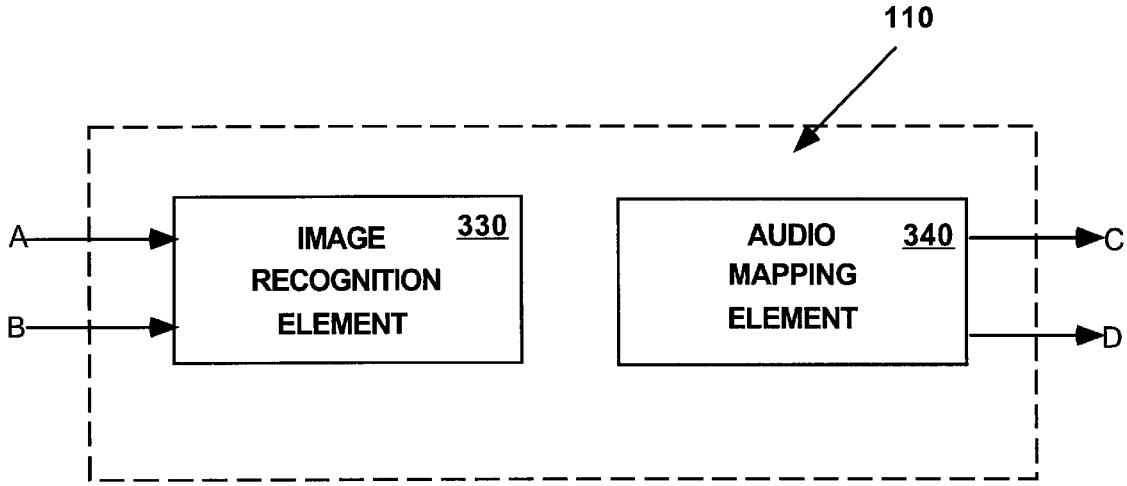
FIG. 3B is a block diagram illustrating one embodiment of image recognition to audio recognition.

Since the receptors are video receptors, converter 110 can also perform image recognition, as shown in FIG. 3B. A library of shapes and objects can be created, updated, and stored in image recognition element 330. The library could even be dynamically updated, adding new items to the library as they are encountered. The recognized images can then be mapped to specific audio signals in audio mapping element 340. Audio signals could be quickly recognizable tones for commonly encountered objects, or verbal descriptions of new or rare objects. In this way, tables, chairs, doors, and many other objects could be identified by the sound of the audio representation.

Image recognition, in connection with the video landscaping, could be used to identify the size and shape of an object. For instance, once a user becomes proficient with the device, the identity, dimensions, and location of a door, crosswalk, table top, or person could be ascertained from the audio representation of each. As a user walks toward a doorway, for instance, the user can "hear" that a door is just ahead. As the user gets closer, the height, width, and direction of the door relative to the video receptors are continually updated so the user can make course corrections to keep on path for the doorway. Converter 110 could be calibrated to provide several inches of clearance above the height of the video receptors and to either side to account for the user's head and body. If the user is too tall to walk upright through the doorway, converter 110 could provide a warning signal to the user to duck his head. Other warnings could be provided to avoid various other dangers. For instance, fast moving objects on a collision course with the user could be recognized and an audio signal could warn the user to duck or dodge to one side.

Text recognition could also be incorporated into the invention, allowing the user to hear audio representations of the text. In this way, a user could "hear" street signs, newspaper articles, or even the words on a computer screen. The converter could also include language translation, which would make the invention useful even for people with perfect eyesight when, for instance, traveling in a foreign country.

In alternate embodiments, the present invention could be employed on the frames of glasses. For instance, the video receptors could be affixed to the arms of the frames, pointing forward, and the audio output devices could be small ear inserts that fit in the ear canal. The converter could be located remotely, carried in the user's pocket, or incorporated into the frames. In other embodiments, the present invention could be incorporated in jewelry, decorative hair pins, or any number of inconspicuous and aesthetic settings.

Except for the teachings of the present invention, converter 110 may be represented by a broad category of computer systems known in the art. An example of such a computer system is a computer system equipped with a high performance microprocessor(s), such as the Pentium® processor, Pentium® Pro processor, or Pentium® II processor manufactured by and commonly available from Intel Corporation of Santa Clara, Calif., or the Alpha® processor manufactured by Digital Equipment Corporation of Manard, Mass.

It is to be appreciated that the housing size and design for converter 110 may be altered, allowing it to be incorporated into a headset, glasses frame, a piece of jewelry, or a pocket sized package. Alternately, in the case of the wireless communications connections between converter 110 and video receptors 105*a* and 105*b,* and between converter 110 and audio output device 115*a* and 115*b,* converter 110 could be located centrally, for instance, within the house or office. A separate, rechargeable portable converter could be used for travel outside the range of the centrally located converter. A network of converters or transmission stations could expand the coverage area. The centrally located converter could be incorporated into a standard desktop computer, for instance, reducing the amount of hardware the user must carry.

Figure 4:
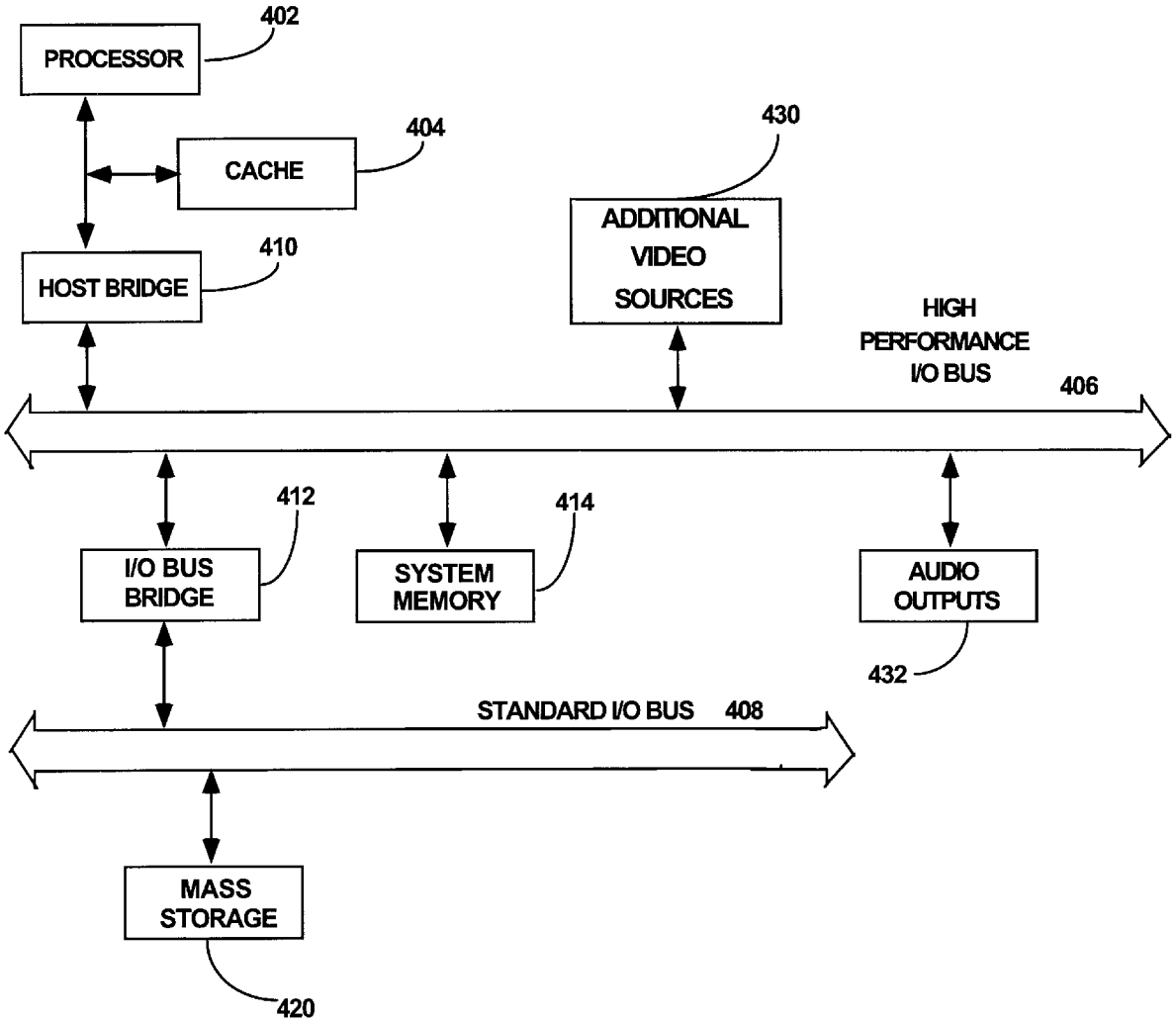
FIG. 4 is a block diagram of one embodiment of a hardware system suitable for use with the present invention.

Such computer systems are commonly equipped with a number of audio and video input and output peripherals and interfaces, which are known in the art, for receiving, digitizing, and compressing audio and video signals. FIG. 4 illustrates one embodiment of a hardware system suitable for use with converter 110 of FIG. 1. In the illustrated embodiment, the hardware system includes processor 402 and cache memory 404 coupled to each other as shown. Additionally, the hardware system includes high performance input/output (I/O) bus 406 and standard I/O bus 408. Host bridge 410 couples processor 402 to high performance I/O bus 406, whereas I/O bus bridge 412 couples the two buses 406 and 408 to each other. System memo 414 is coupled to bus 406. Mass storage 420 is coupled to bus 408. Collectively, these elements are intended to represent a broad category of hardware systems, including but not limited to general purpose computer systems based on the Pentium® processor, Pentium® Pro processor, or Pentium® II processor, manufactured by Intel Corporation of Santa Clara, Calif.

In one embodiment, various electronic devices are also coupled to high performance I/O bus 406. As illustrated, video input device 430 and audio outputs 432 are also coupled to high performance I/O bus 406. These elements 402–432 perform their conventional functions known in the art.

Mass storage 420 is used to provide permanent storage for the data and programming instructions to implement the above described functions, whereas system memory 414 is used to provide temporary storage for the data and programming instructions when executed by processor 402.

It is to be appreciated that various components of the hardware system may be rearranged. For example, cache 404 may be on-chip with processor 402. Alternatively, cache 404 and processor 402 may be packed together as a "processor module", with processor 402 being referred to as the "processor core". Furthermore, certain implementations of the present invention may not require nor include all of the above components. For example, mass storage 420 may not be included in the system. Additionally, mass storage 420 shown coupled to standard I/O bus 408 may be coupled to high performance I/O bus 406; in addition, in some implementations only a single bus may exist with the components of the hardware system being coupled to the single bus. Furthermore, additional components may be included in the hardware system, such as additional processors, storage devices, or memories.

In one embodiment, converter 110 as discussed above is implemented as a series of software routines run by the hardware system of FIG. 4. These software routines comprise a plurality or series of instructions to be executed by a processor in a hardware system, such as processor 402 of FIG. 4. Initially, the series of instructions are stored on a storage device, such as mass storage 420. It is to be appreciated that the series of instructions can be stored using any conventional storage medium, such as a diskette, CD-ROM, magnetic tape, digital video or versatile disk (DVD), laser disk, ROM, Flash memory, etc. It is also to be appreciated that the series of instructions need not be stored locally, and could be received from a remote storage device, such as a server on a network. The instructions are copied from the storage device, such as mass storage 420, into memory 414 and then accessed and executed by processor 402. In one implementation, these software routines are written in the C++ programming language. It is to be appreciated, however, that these routines may be implemented in any of a wide variety of programming languages.

In alternate embodiments, the present invention is implemented in discrete hardware or firmware. For example, one or more application specific integrated circuits (ASICs) could be programmed with the above described functions of the present invention. By way of another example, converter 110 of FIG. 1 could be implemented in one or more ASICs of an additional circuit board for insertion into the hardware system of FIG. 4.

Thus, a method and apparatus for providing an audio representation of a three dimensional environment is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. A method comprising:

receiving multidimensional video data by a plurality of video receptors;

converting the multidimensional video data from the plurality of video receptors to a multidimensional audio representation of the multidimensional video data, converting the multidimensional video data including:

generating a three-dimensional representation of the multidimensional video data; and generating an audio landscape representation with three-dimensional features based on the three-dimensional representation; and outputting the multidimensional audio representation by a plurality of audio output devices.

2. The method of claim 1, wherein the receiving the multidimensional video data by the plurality of video receptors is performed using a plurality of video cameras.

3. The method of claim 1, wherein the receiving the multidimensional video data by the plurality of video receptors includes the plurality of video receptors being affixed to a head of a user and being situated such that light is received from the general direction in which the head is pointed.

4. The method of claim 1, wherein the converting the multidimensional video data includes:

performing image recognition to determine recognized images from the multidimensional video data; and mapping the recognized images to specific audio signals.

5. The method of claim 1, wherein the converting the multidimensional video data includes:

recognizing text from the multidimensional video data; and generating audio signals equivalent to the text.

6. The method of claim 5, wherein the generating the audio signals equivalent to the text includes language translation.

7. The method of claim 1, wherein the converting the multidimensional video data includes providing a warning signal based on the multidimensional video data.

8. The method of claim 1, wherein the plurality of audio output devices includes one of headphones, ear inserts, or stereo speakers.

9. The method of claim 1, wherein generating a video landscape includes determining the distance between the plurality of video receptors and an object that is in view of the plurality of video receptors based at least in part on the differences in perspective of the object obtained from two or more of the video receptors.

10. The method of claim 9, wherein generating a video landscape includes determining the distance between the video receptors and the ground surface.

11. The method of claim 10, wherein determining the distance between the video receptors and the ground surface includes calculating the angle of the video receptors in relation to an identified point on the surface.

12. The method of claim 11, wherein calculating the angle of the video receptors in relation to an identified point on the ground surface including obtaining an angle of inclination of the video receptors.

13. An apparatus comprising:

a plurality of video receptors to receive light input and provide multidimensional video data;

a plurality of audio output devices to provide multidimensional audio output; and a converter, coupled with the plurality of video receptors and the plurality of audio output devices, to receive the multidimensional video data from the plurality of video receptors, convert the multidimensional video data into a multidimensional audio representation of the multidimensional video data, and output the multidimensional audio representation to the plurality of audio output devices, the converter comprising:

a first generator to compile the multidimensional video data into a video landscape with three dimensional features; and a second generator, coupled to the first generator, to generate an audio landscape representation with three dimensional features based on the video landscape.

14. The apparatus of claim 13 wherein the plurality of video receptors includes video cameras.

15. The apparatus of claim 13 wherein the plurality of video receptors are affixed to a head of a user and receive light from the general direction in which the head is pointed.

16. The apparatus of claim 13, wherein:

the first generator receives the multidimensional video data and performs image recognition to determine recognized images; and the second generator maps the recognized images to specific audio signals.

17. The apparatus of claim 13, wherein the converter is coupled to the plurality of video receptors and the plurality of audio output devices by wireless communication media.

18. The apparatus of claim 13, wherein the plurality of audio output devices includes one of headphones, ear inserts, and stereo speakers.

19. The apparatus of claim 13, further comprising one or more inclination sensors to determine the inclination of the plurality of video receptors.

20. The apparatus of claim 19, wherein the apparatus determines the height of the plurality of video receptors above ground level at least in part by determining an angle between the plurality of video sensors and an identified point on the ground surface, wherein the angle is determined at least in part by obtaining the inclination of the plurality of video receptors using the one or more inclination sensors.

21. A system comprising:

a plurality of video receptors to receive light input and provide multidimensional video data;

a plurality of audio output devices to provide multidimensional audio output; and a processor, coupled the plurality of video receptors and the plurality of audio output devices, to receive the multidimensional video data from the plurality of video receptors, convert the multidimensional video data into a multidimensional audio representation of the multidimensional video data, and output the multidimensional audio representation to the plurality of audio output devices, converting the multidimensional video data including:

generating a three-dimensional representation of the multidimensional video data; and generating an audio landscape with three-dimensional features based on the three-dimensional representation.

22. A machine-readable storage medium having stored therein a plurality of programming instructions, designed to be executed by a processor, wherein the plurality of programming instructions implements the method of:

receiving multidimensional video data by a plurality of video receptors;

converting the multidimensional video data from the plurality of video receptors to a multidimensional audio representation of the multidimensional video data, converting the multidimensional video data including:

generating a three-dimensional representation of the multidimensional video data; and generating an audio landscape with three-dimensional features based on the three-dimensional representation; and outputting the multidimensional audio representation by a plurality of audio output devices.

* * * * *

UNITED STATES PATENT AND TRADEMARK OFFICE

CERTIFICATE OF CORRECTION

PATENT NO. : 6,523,006 B1 
DATED : February 18, 2003
INVENTOR(S) : Ellis et al.

It is certified that error appears in the above-identified patent and that said Letters Patent is hereby corrected as shown below:

Column 4,
Line 44, delete “memo” and insert -- memory --.

Signed and Sealed this

Twenty-seventh Day of December, 2005

JON W. DUDAS
*Director of the United States Patent and Trademark Office*